US005689750A

United States Patent [19]

Verlinden et al.

[11] Patent Number: 5,689,750

[45] Date of Patent: Nov. 18, 1997

[54] APPARATUS FOR THE WET PROCESSING OF PHOTOGRAPHIC SHEET MATERIAL

[75] Inventors: Bartholomeus Verlinden, Tongeren; Marc De Niel, Borgerhout; Bart Verhoest, Wilrijk, all of Belgium

[73] Assignee: Agfa-Gevaert N.V., Mortsel, Belgium

[21] Appl. No.: 643,795

[22] Filed: May 7, 1996

[30] Foreign Application Priority Data

May 20, 1995 [EP] European Pat. Off. ..... 95201328

[51] Int. Cl.[6] ..... G03D 3/08

[52] U.S. Cl. ..... 396/614; 396/622; 396/636

[58] Field of Search ..... 354/319, 320, 354/322, 324, 331; 396/614, 622, 624, 626, 636, 617; 134/64 P, 122 P

[56] References Cited

U.S. PATENT DOCUMENTS 4,166,689 9/1979 Schausberger et al. ..... 354/322
4,616,915 10/1986 Norris ..... 354/320
5,452,041 9/1995 Claes et al. ..... 354/318
5,455,651 10/1995 Verhoest et al. ..... 354/320
5,479,232 12/1995 Ven Den Bergen et al. ..... 354/324

*Primary Examiner*—A. A. Mathews
*Attorney, Agent, or Firm*—Brumbaugh, Graves, Donohue & Raymond

[57] ABSTRACT

An apparatus for the wet processing of photographic sheet material comprises at least one treatment vessel (12, 12', 12") having upper and lower openings (17, 18), one of the openings (17) constituting a sheet material inlet and the other of the openings (18) constituting a sheet material outlet, the inlet and outlet defining there-between a substantially vertical sheet material path (20) through the vessel. The vessel comprises a rotatable roller (28) biased towards a reaction surface (30) to define a roller nip (36) there-between through which the sheet material path extends and associated with sealing means (38) to retain treatment liquid (24) in the vessel (12). The apparatus is characterised in that the roller (28) comprises a core (32) carrying a covering (34) of elastomeric material, the ratio ($\phi$/L) of the maximum diameter ($\phi$) of the elastomeric material covering to the length (L) thereof being at least 0.012.

14 Claims, 4 Drawing Sheets

APPARATUS FOR THE WET PROCESSING OF PHOTOGRAPHIC SHEET MATERIAL

FIELD OF THE INVENTION

The present invention relates to an apparatus for the wet processing of photographic sheet material, such as X-ray film, pre-sensitised plates, graphic art film and paper, and offset plates. More particularly the invention relates to improvements in apparatus in which photographic material is transported through one or more treatment units along a vertical feed path.

BACKGROUND OF THE INVENTION

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus.

In a vertically oriented apparatus, it is important to avoid, or at least minimise leakage of treatment liquid from one vessel to another and carry-over as the sheet material passes through the apparatus. U.S. Pat. No. 4,166,689 (Schausberger et al. assigned to Agfa-Gevaert AG) describes such an apparatus in which liquid escapes from the lower opening and is intercepted by the tank of a sealing device with two squeegees located in the tank above a horizontal passage in line with the lower opening. One or more pairs of drive rollers in the vessel close the lower opening and also serve to transport the sheet material along a vertical path which extends between the openings of the vessel.

When processing sheet material such as films and plates, the sheet material passes between pairs of rollers which are usually biased towards each other to define a nip therebetween. Typical rollers have a core provided with a covering of elastomeric material, although it is possible for the roller to be elastomeric throughout its cross-section. As the sheet material leaves a given liquid treatment vessel it is necessary to remove any liquid carried on the sheet material as efficiently as possible, to prevent carry-over of liquid into a next treatment vessel and to reduce edge effects which arise from non-homogeneous chemistry on the sheet material after squeegeeing. This applies whether the apparatus is of a horizontal or vertical configuration. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm and a diameter of from 24 to 30 mm. The sheet material typically has a width of from a few millimetres up to 2 m and a thickness of 0.05 mm to 0.5 mm. In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip.

SUMMARY OF THE INVENTION

We have surprisingly found that the objective of a minimum leak zone referred to above can be achieved if the ratio of the diameter of the roller to its length is above a critical limit.

According to the invention there is provided an apparatus for the wet processing of photographic sheet material comprising at least one treatment vessel having upper and lower openings, one of the openings constituting a sheet material inlet and the other of the openings constituting a sheet material outlet, the inlet and outlet defining there-between a substantially vertical sheet material path through the vessel, the vessel comprising a rotatable roller biased towards a reaction surface to define a nip there-between through which the sheet material path extends and associated with sealing means to retain treatment liquid in the vessel, characterised in that the roller comprises a core carrying a covering of elastomeric material, the ratio ($\phi$/L) of the maximum diameter ($\phi$) of the roller to the length (L) thereof being at least 0.012, most preferably between 0.03 and 0.06. Preferably both rollers conform to this requirement, although it is possible that the diameters ($\phi$), and therefore the ratios ($\phi$/L), of the two rollers need not be identical.

The reaction surface towards which the roller is biased to define the nip will usually be another roller, and it is preferred that requirements of the present invention applies to this, second, roller also. Indeed, it will be usual for the two rollers to be identical. It is however also possible that the reaction surface may be formed by a second roller which does not conform to the above requirements, such as for example, a roller having no elastomeric covering, or for the reaction surface to be in the form of a belt or a fixed surface with a low friction coefficient. Where this general description refers to the use of two rollers, both conforming to the requirements of the present invention, it is to be understood that the second roller may be replaced by any other reaction surface, such as those referred to above.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber. The hardness of the elastomeric material may be between 15 Shore (A) and 90 Shore (A), as measured on the roller surface. In one embodiment of the invention, the diameter ($\phi$) of the elastomeric material covering is constant along the length of the roller. Alternatively the roller may have a radial dimension profile which varies along the length thereof. In the latter case, the diameter ($\phi$) in the expression $\phi/L$ is the maximum diameter. In a preferred embodiment, such a roller comprises a non-deformable core, the thickness of the elastomeric material covering varying along the length thereof. Alternatively or additionally, the diameter of the core varies along the length thereof.

Ideally, the radial dimension profile of such a roller is such in relation to the force applied by the roller to sheet material passing through the nip as to be substantially even over the width thereof.

The radial dimension of the roller ideally decreases towards the ends thereof i.e. a convex profile, especially a parabolic profile.

Preferably, the core has a flexural E-modulus of between 50 GPa and 300 GPa. Suitable materials for the rigid core include metals, such as stainless steel, non-ferrous alloys, titanium, aluminium or a composite thereof.

In one embodiment of the invention, the core is hollow. Alternatively the core may be solid.

In a preferred embodiment of the invention, the rollers are substantially equal in length. One or both of the rollers may constitute drive rollers for driving the sheet material along the sheet material path. Alternatively, the rollers may be freely rotating, alternative drive means being provided to drive the photographic sheet material through the apparatus.

The rollers may be biased together by a variety of methods. The rollers may be biased together for example by making use of the intrinsic elasticity of the elastomeric material by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

Each vessel may be of modular construction and be provided with means to enable the vessel to be mounted directly above or below an identical or similar other vessel. Alternatively, the apparatus may take an integral or semi-integral form. By the term "semi-integral form" we intend to include an apparatus which is divided by a substantially vertical plane passing through all the vessels in the apparatus, particularly the plane of the sheet material path, enabling the apparatus to be opened-up for servicing purposes, in particular to enable easy access to the rollers.

We prefer an apparatus in which each vessel is so constructed as to provide a substantially closed connection between adjacent vessels.

Each vessel of the apparatus may comprise a housing having an upper housing part and a lower housing part, the upper housing part being so shaped in relation to the lower housing part of the next higher vessel as to provide the substantially closed connection between adjacent vessels. For example, the upper and lower housing wall parts may be provided with flanges, means being provided to secure the flange of the upper housing wall part with the flange of the lower housing wall part of the next higher vessel thereby to provide the substantially closed connection. Optionally, a gasket may be positioned between the vessels to improve the reliability of this connection.

In each vessel it is desirable that the sealing of the rollers to the vessel is achieved in a simple and reliable manner.

We therefore prefer a construction in which the rollers which close the lower opening of a treatment vessel are axially offset relative to each other and each roller is in sealing contact along its length, at least between the limits of the nip, with a stationary sealing member.

The sealing member preferably includes a portion which extends longitudinally along the surface of the associated roller. This longitudinal part of the sealing member may extend in a straight line parallel to the associated roller axis and preferably contacts the surface of the associated roller at a location which is between 45° and 225°, most preferably between 80° and 100° from the centre of the nip, on the fluid side. The benefit of this arrangement is that the sealing members do not influence the bias forces between the rollers, or only influence these forces to a limited extent.

In a preferred construction of the apparatus, the sealing member is carried on a sealing support, secured within the vessel.

By arranging for the rollers to be axially offset with respect to each other, it is possible that the sealing member may include a portion which extends circumferentially around the surface of its associated roller. To ensure a good seal at this point, the sealing support may be in contact with the end face of the opposite roller. Means, such as sinus springs incorporated in the roller mountings, may be provided for pulling each of the rollers against a respective end plate of the sealing support with a force of from 2 to 500 g/cm of contact between the end plate and the end face of the roller, measured at the surface of the roller. In order to reduce the torque required to rotate the rollers, the ratio of the roller diameter $\phi$ to the length of the nip is preferably greater than 0.012.

The sealing member may be in a unitary or composite form which exerts a spring force of between 2 and 500 g/cm of roller, perpendicular to the roller surface. The spring loading may be derived from the geometry of a unitary sealing member, from a separate spring incorporated in a composite sealing member, or simply from the compression of the elastomeric material covering of the associated roller. The sealing member material which is in contact with the associated roller surface preferably has a coefficient of friction (as measured against stainless steel) of from 0.05 to 0.3, preferably from 0.09 to 0.2. The sealing member material in contact with the associated roller surface may comprise a polymer material such as PTFE (poly tetra fluoro ethylene), POM (polyoxymethylene), HDPE (high density polyethylene), UHMPE (ultra high molecular weight polyethylene) or PA (polyamide). We prefer to use a PTFE profile backed with a stainless steel spring.

The top-most liquid-containing vessel of the apparatus is preferably provided with similar closure means for reducing the evaporation, oxidation and carbonization of treatment liquid therefrom.

The upper part of the housing of each vessel (optionally other than the top-most) is preferably so shaped as to define a leakage tray so positioned that any treatment liquid which passes, for example, through the roller nip of the next higher vessel drips from the rollers of that vessel and falls into the leakage tray, for collection and recirculation as desired.

By the use of a vertical configuration, the cross-section of the vessel can be low, such as less than 3 times the roller diameter. The volume of the vessel can therefore be low. Indeed, for a given sheet material path length, the volume of one vessel of a vertical processing apparatus can be many times smaller than the volume of an equivalent treatment bath in a horizontal processing apparatus.

This has advantages in terms of the volume of treatment liquids used and the efficiency of their interaction with the sheet material.

Nevertheless, one or more of the vessels of the apparatus may include additional features if desired. Cleaning means may be provided for acting upon the rollers to remove debris therefrom, as described in European patent application EP 93202862 (Agfa-Gevaert NV), filed 11 Oct. 1993. Additional rollers, such as a roller pair or staggered rollers may be provided for transporting the sheet material through the apparatus, and these rollers will normally be driven rollers. Additional roller pairs may be provided for breaking the laminar fluid at the surface of the sheet material as it passes through the apparatus, and these rollers may be driven rollers or freely rotating rollers. Even when additional roller pairs are present, the rollers to which the ($\phi$/L) criterium applies and their associated sealing means will usually constitute the lower roller pair, serving to close the lower opening of the vessel. Spray means may be provided for applying treatment liquid to the sheet material. Guide means may be included for guiding the passage of the sheet material through the apparatus. Heating means may be provided in one or more vessels so that the vessel becomes a sheet material drying unit, rather than a wet treatment unit. While liquid pumping, heating, cooling and filtering facilities will normally be provided outside the vessels, it is possible for some elements of these features to be included in the vessels themselves. Any combination of these additional features is also possible.

In one embodiment of the invention, one or more of the vessels includes at least one passage through the housing thereof to constitute an inlet and/or outlet for treatment liquid into and/or from the associated vessel. One or more vessels may not contain processing liquid, these vessels providing a dead space where diffusion reactions can occur on the sheet material as it passes there-through.

PREFERRED EMBODIMENTS OF THE INVENTION

The invention will now be further described, purely by way of example, by reference to the accompanying drawings in which.

Although only one specific embodiment of a treatment vessel according to the invention is shown in the Figures, the invention is not restricted thereto. The apparatus for the wet processing of photographic sheet material such as X-ray film as shown in the Figures comprises a plurality of treatment vessels mounted one above another. These vessels may be arranged to provide a sequence of steps in the processing of sheet photographic material, such as developing, fixing and rinsing. The vessels may be of a modular structure as shown or may be part of an integral apparatus.

Figure 1:
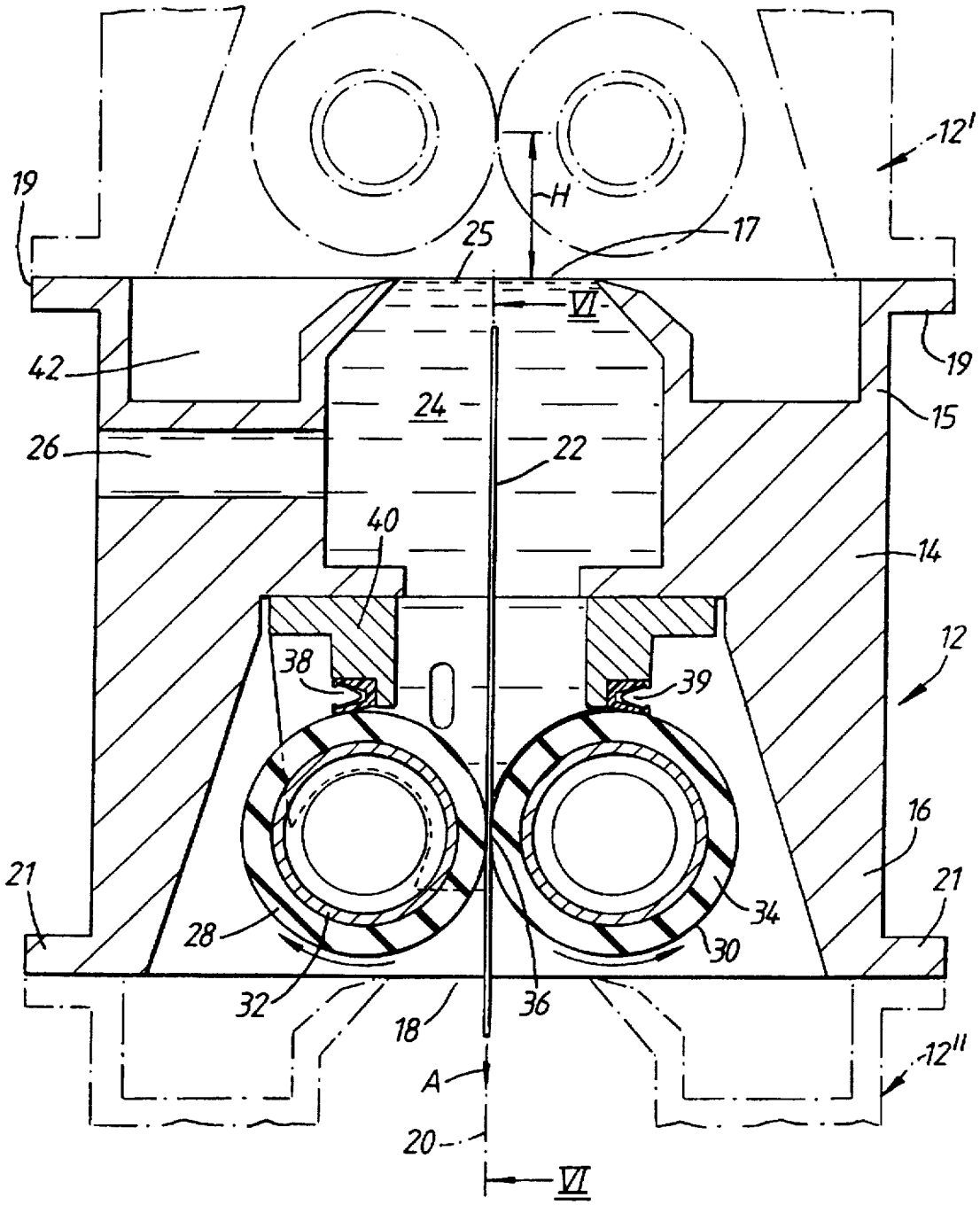
FIG. 1 is, in solid lines, a cross-sectional view of one vessel of a vertical processing apparatus according to the invention, with adjacent vessels being partly shown in broken lines.

As shown in FIG. 1, each vessel 12 comprises a housing 14 which is of generally rectangular cross-section and is so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the vessel 12, the sheet material 22 moving in a downwards direction as indicated by the arrow A. The sheet material preferably has a width which is at least 10 mm smaller than the length of the nip, so as to enable a spacing of at least 5 mm between the edges of the sheet and the adjacent limit of the nip, thereby to minimise leakage. Each vessel 12 may contain treatment liquid 24, a passage 26 in the housing 14 being provided as an inlet for the treatment liquid 24. The lower opening 18 is closed by a pair of rotatable rollers 28, 30 carried in the apparatus.

Each roller 28, 30 is of the squeegee type comprising a stainless steel hollow core 32 carrying an elastomeric covering 34. The core 32 is in cylindrical form having constant internal and external diameters along the length thereof. The rollers 28, 30 are biased towards each other with a force sufficient to effect a liquid tight seal but without causing damage to the photographic sheet material 22 as it passes there-between. The line of contact between the rollers 28, 30 defines a nip 36. The rollers 28, 30 are coupled to drive means (not shown) so as to constitute drive rollers for driving the sheet material 22 along the sheet material path 20.

Each roller 28, 30 is in sealing contact along its length, with a respective stationary sealing member 38, 39 carried on a sealing support 40, which in turn is secured to the housing 14 of the vessel 12, the treatment liquid 24 being retained in the vessel 12 by the rollers 28, 30 and the sealing members 38, 39. The sealing members 38, 39 are formed of PTFE and have a composite structure as shown more clearly in FIG. 2, referred to below. The sealing members 38, 39 are secured to the sealing support 40 by a suitable, water- and chemical-resistant adhesive, such as a silicone adhesive.

The upper and lower housing parts 15, 16 are provided with flanges 19, 21 respectively to enable the vessel 12 to be mounted directly above or below an identical or similar other vessel 12', 12", as partly indicated in broken lines in FIG. 1. The upper housing part 15 is so shaped in relation to the lower housing part 16 as to provide a substantially closed connection between adjacent vessels. Thus, treatment liquid from vessel 12 is prevented from falling into the lower vessel 12" by the rollers 28, 30 and sealing members 38, 39, while vapours from the lower vessel 12" are prevented from entering the vessel 12 or escaping into the environment. This construction has the advantage that the treatment liquid in one vessel 12 is not contaminated by contents of the adjacent vessels and that by virtue of the treatment liquids being in a closed system evaporation, oxidation and carbonization thereof and any other undesirable exchange between the treatment liquid and the environment are significantly reduced.

The upper part 15 of the housing 14 is so shaped as to define a leakage tray 42. Any treatment liquid which may pass through the roller nip of the next higher vessel 12', in particular as the sheet material 22 passes therethrough, drips from the rollers of that vessel and falls into the leakage tray 42 from where it may be recovered and recirculated as desired. The distance H between the surface 25 of the liquid 24 and the nip of the rollers of the next upper vessel 12' is as low as possible.

Figure 2:
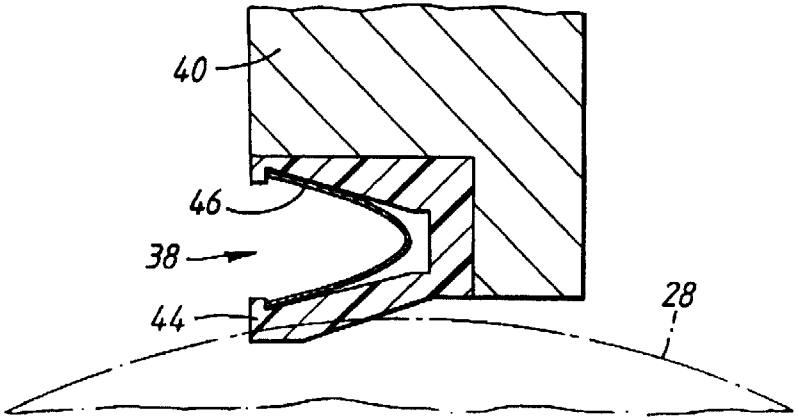
FIG. 2 is a cross-sectional view of a sealing member forming part of the vessel shown in FIG. 1, together with part of adjacent components.

As can be seen more clearly in FIG. 2, the sealing member 38 is of composite structure having an open profile 44 formed of PTFE, within which profile is incorporated a stainless steel spring 46. FIG. 2 also shows how the sealing member 38 is retained in the sealing support 40. In FIG. 2, the sealing member 38 is shown in its relaxed position, the outline of the roller 28 also being shown in this Figure. The two sealing members 38, 39 are identical in the illustrated embodiment. In another preferred embodiment, the profile of the sealing member could also be closed.

Figure 3:
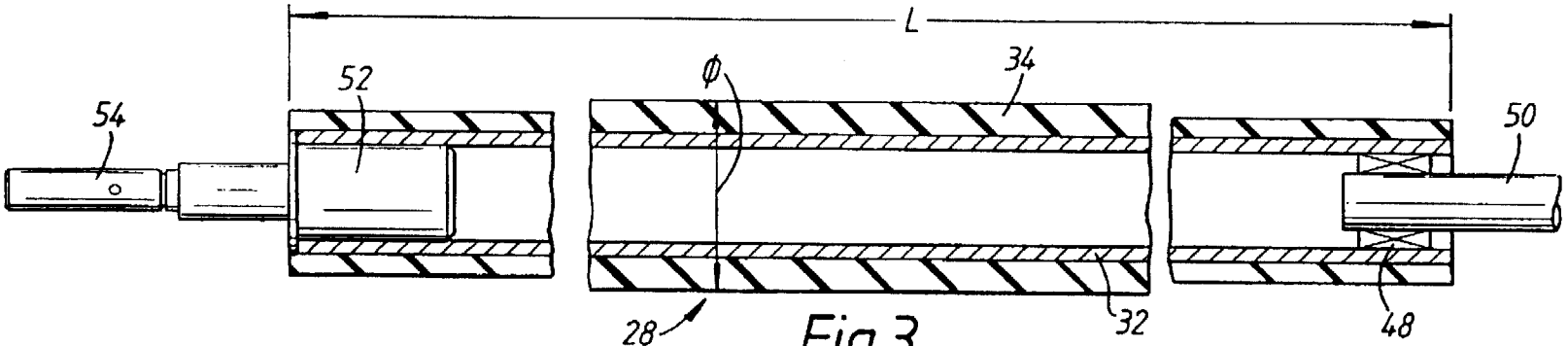
FIG. 3 is a longitudinal cross-sectional view showing the detail of the construction of one roller used in the vessel shown in FIG. 1.

The construction of roller 28 is shown in more detail in FIG. 3. The construction of roller 30 is similar. The roller 28 comprises a core 32 of stainless steel, having a constant outside diameter of 25 mm and an internal diameter of 19 mm. The stainless steel core 32 has a flexural E-modulus of 210 GPa. The core 32 is provided with a covering 34 of EPDM rubber, an elastomer having a hardness of 30 Shore (A). The covering 34 has a thickness varying from 7 mm at the roller ends to 7.5 mm at the roller centre. The roller 28 has a length of 750 mm and a maximum diameter of 40 mm. The maximum $\phi/L$ ratio is therefore approximately 0.053.

FIG. 3 also shows two possible methods of mounting the roller, one at each end thereof. In practice, it will be usual to use one method only at both ends. At the right hand end of FIG. 3, an internal bearing 48 is provided in which a fixed shaft 50 is located, the shaft being fixedly carried in the apparatus. At the left-hand end of FIG. 3, a spindle 52 is fixedly retained in the hollow core 32 and has a spindle end 54 which extends into a bearing (not shown) in the apparatus, or carries a drive wheel thereon. This construction is suitable for that end of the roller which transmits the drive.

Figure 5:
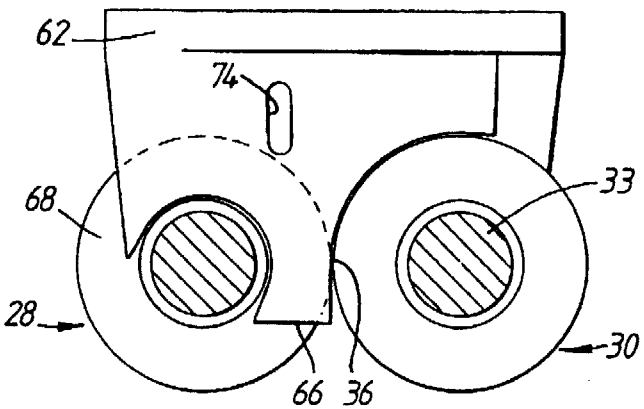
FIG. 5 is an end view of the sealing support and rollers taken in the direction V—V in FIG. 4.
Figure 4:
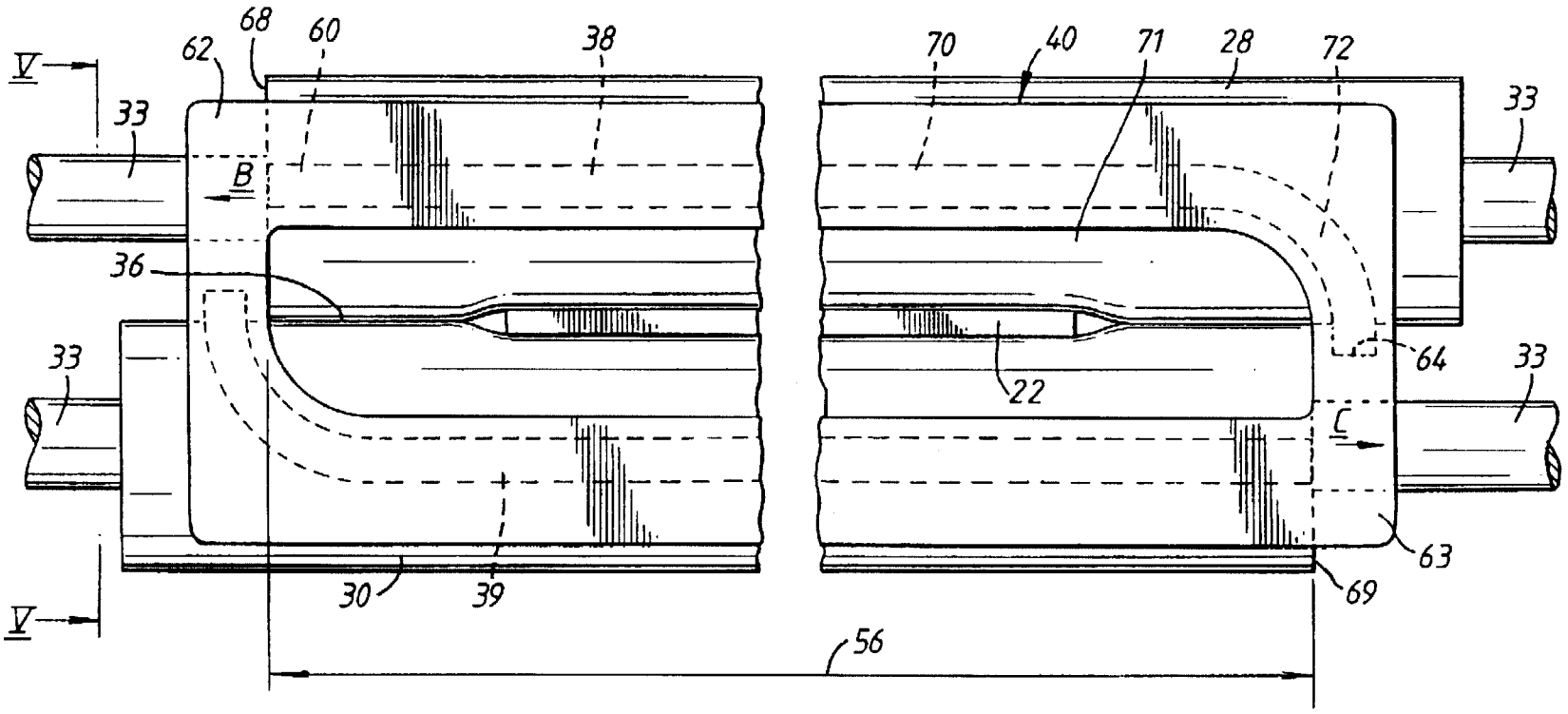
FIG. 4 is a view from above showing the sealing support and rollers of the vessel shown in FIG. 1.
Figure 6:
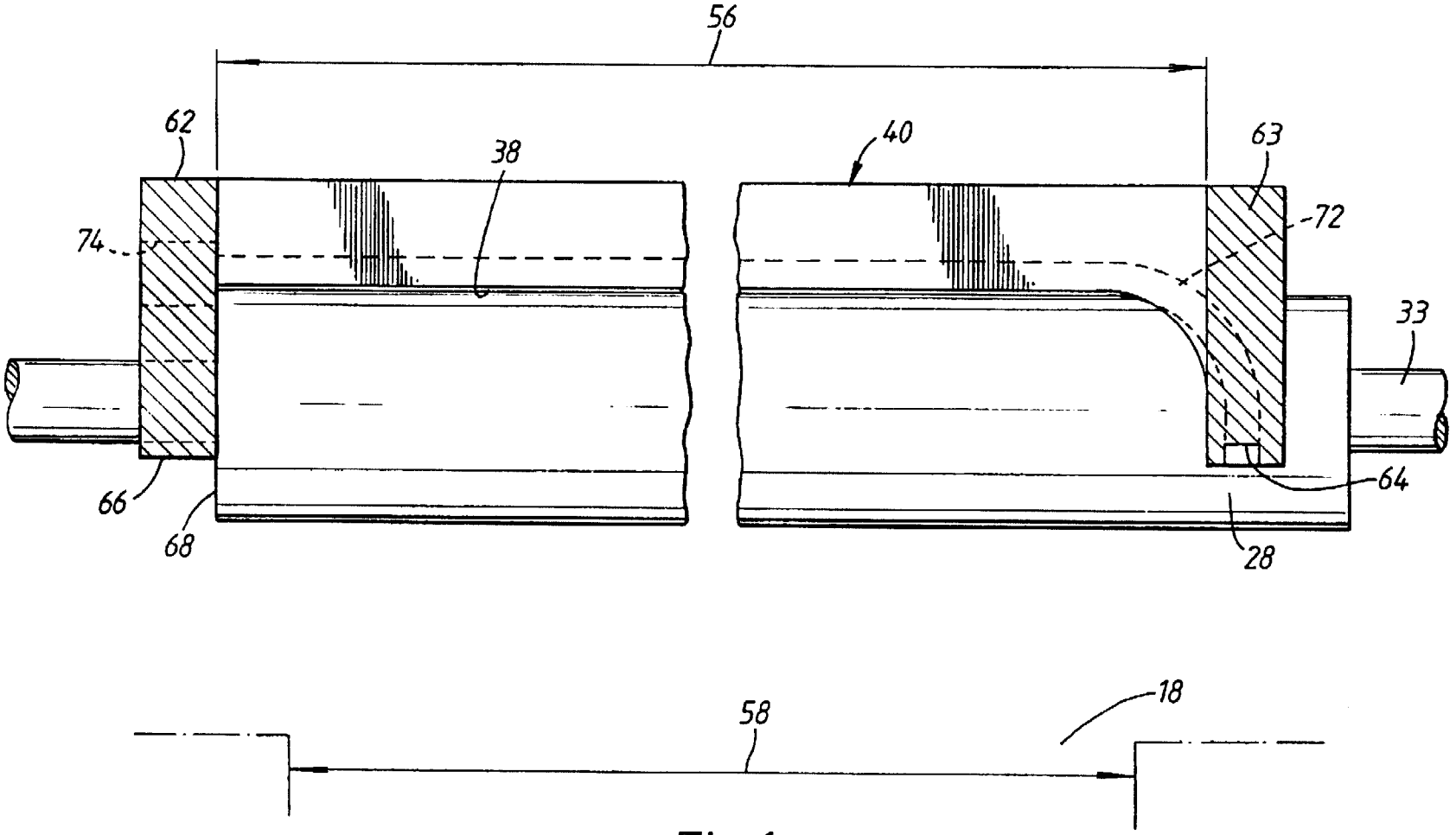
FIG. 6 is a side view of part of the sealing support and one roller taken in the direction VI—VI in FIG. 1.

As indicated in FIGS. 4, 5 and 6, the rollers 28, 30 are axially offset relative to each other. In the illustrated embodiment, the nip 36 has a length which extends between limits 56 beyond the limits 58 of the lower opening 18. The rollers 28, 30 are substantially equal in length.

The end plate 62 of the sealing support 40 is so shaped as to have a lower edge 66 which follows a circumferential line around the shaft 33 of the first roller 28 and a circumferential line around the second roller 30 to enable the end plate to be in face-to-face contact with the end face 68 of the first roller 28. At its lowest point, the edge 66 is below the level of the nip 36. The circumferential distance over which the end plate 62 is in contact with the end face 68 of the first roller 28 is larger than the circumferential distance between the nip 36 and the sealing member 38.

One end 60 of the sealing member 38 is pulled against an end plate 62. To achieve this, the roller 28 is pulled in the direction of the arrow B by sinus springs, not shown, incorporated in the roller mountings. A suitable pulling force is from 2 to 500 g/cm of contact between the end plate 62 of the sealing support 40 and the end face 68 of the roller 28 measured at the surface of the roller. The sealing member 38 includes a portion 70 which extends longitudinally in a straight line away from the end plate 62 along the surface 71 of the first roller 28. The sealing member 38 contacts the surface 71 of the first roller 28 at a location which is about 90° from the centre of the nip 36 on the fluid side, that is from the plane joining the axes of rotation of the rollers 28, 30. By arranging for the rollers 28, 30 to be axially offset with respect to each other, it is made possible for the sealing member 38 to include a portion 72, which extends circumferentially around the surface of the first roller 28. This circumferentially extending portion 72 of the sealing member 38 completes a sealing path to the opposite end plate 63, where the end of the sealing member 38 is retained in a blind aperture 64 formed in the end plate 63, while the end plate 63 bears against the end face 69 of the second roller 30. The second sealing member 39 is similarly constructed and retained in the sealing support 40, the roller 30 being pulled in the direction of the arrow C. The two sealing members 38, 39 and the two end plates 62, 63 of the sealing support 40 thereby complete a continuous sealing path which, together with the roller nip 36 retains the treatment liquid 24 in the vessel 12.

The end plates 62, 63 each include an aperture 74, the lower edge of which is positioned below the level of the top of the rollers 28, 30, enabling the bulk of the treatment liquid 24 to flow out of the vessel at each end thereof and to be recirculated as desired.

We claim:

1. An apparatus for the wet processing of photographic sheet material having a thickness of 0.05 mm to 0.5 mm comprising at least one treatment vessel (12, 12', 12") having upper and lower openings (17, 18), one of said openings (17) constituting a sheet material inlet and the other of said openings (18) constituting a sheet material outlet, said inlet and outlet defining there-between a substantially vertical sheet material path (20) through said vessel, said vessel including a sealing arrangement at said lower opening comprising a rotatable roller (28) biased towards a reaction surface (30) to define a roller nip (36) there-between through which the sheet material path extends and a stationary sealing member (38, 39) bearing against said roller in sealing contact along its length to retain treatment liquid (24) in said vessel (12), said roller (28) comprising a core (32) carrying a covering (34) of elastomeric material, the ratio ($\phi/L$) of the maximum diameter ($\phi$) of the roller to the length (L) thereof being at least 0.012.

2. An apparatus according to claim 1, wherein said reaction surface comprises a further roller (30).

3. An apparatus according to claim 2, wherein said further roller comprises a core (32) carrying a covering (34) of elastomeric material, the ratio of the maximum diameter ($\phi$) of the elastomeric material covering to the length (L) thereof being at least 0.012.

4. An apparatus according to claim 1, wherein said ratio ($\phi/L$) is between 0.03 and 0.06.

5. An apparatus according to claim 1, wherein said elastomeric material covering (34) has a thickness of between 1 mm and 30 mm.

6. An apparatus according to claim 1, wherein said elastomeric material is selected from ethylene/propylene/diene terpolymers, silicone rubber, polyurethane, thermoplastic rubber, styrene-butyl rubber and nitrile-butyl rubber.

7. An apparatus according to claim 1, wherein the hardness of said elastomeric material is between 15 Shore (A) and 90 Shore (A), measured on the roller surface.

8. An apparatus according to claim 1, wherein said core (32) has a flexural E-modulus of between 50 GPa and 300 GPa.

9. An apparatus according to claim 1, wherein the ratio of the roller diameter $\phi$ to the length (56) of the nip (36) is greater than 0.012.

10. An apparatus according to claim 1, wherein said diameter ($\phi$) of said elastomeric material covering is constant along the length of the roller.

11. An apparatus according to claim 1, wherein said roller has a radial dimension profile which varies along the length thereof.

12. An apparatus according to claim 1, wherein said elastomeric material covering (34) has a thickness of between 1 mm and 30 mm and the hardness of said elastomeric material is between 15 Shore (A) and 90 Shore (A), measured on the roller surface.

13. An apparatus according to claim 1, wherein said reaction surface comprises a further roller (30), said elastomeric material covering (34) has a thickness of between 1 mm and 30 mm, the hardness of said elastomeric material is between 15 Shore (A) and 90 Shore (A), measured on the roller surface, and said core (32) has a flexural E-modulus of between 50 GPa and 300 GPa.

14. An apparatus according to claim 1, wherein said sealing member (38, 39) contacts the surface of said roller (28) at a location which is between 45° and 225° from the centre of the nip (36), on the fluid side.

* * * * *